United States Patent [19]

Raetzsch, Jr.

[11] Patent Number: 4,461,692

[45] Date of Patent: Jul. 24, 1984

[54] ELECTROLYTIC CELL

[75] Inventor: Carl W. Raetzsch, Jr., Corpus Christi, Tex.

[73] Assignee: PPG Industries, Inc., Pittsburgh, Pa.

[21] Appl. No.: 382,022

[22] Filed: May 26, 1982

[51] Int. Cl.[3] ..... C25B 9/00; C25B 11/02

[52] U.S. Cl. ..... 204/268; 204/269; 204/270; 204/284

[58] Field of Search ..... 204/284, 268, 254, 59 AM, 204/280, 283, 284

[56] References Cited

U.S. PATENT DOCUMENTS

| | | | |
|---|---|---|---|
| 1,862,244 | 6/1932 | Stuart | 204/283 |
| 2,799,643 | 7/1957 | Raetzsch | 204/270 |
| 3,819,504 | 6/1974 | Bennett | 204/284 |
| 3,859,197 | 1/1975 | Boug et al. | 204/284 |
| 3,871,988 | 3/1975 | Harke et al. | 204/284 |
| 3,902,985 | 9/1975 | Raetzsch et al. | 204/268 |
| 4,075,070 | 2/1978 | DuBois et al. | 204/129 |
| 4,197,182 | 4/1980 | Fitch et al. | 204/284 |
| 4,305,806 | 12/1981 | Holca | 204/268 |

*Primary Examiner*—T. Tung
*Assistant Examiner*—Nathan Thane
*Attorney, Agent, or Firm*—Mark Levin; Richard M. Goldman

[57] ABSTRACT

Discloses an electrolytic cell having base-to-base bipolar electrodes in side-by-side configuration in a cell box where the cathodes are fabricated of titanium. The cathodes adjacent to external walls are perforated whereby to avoid hydride formation.

4 Claims, 3 Drawing Figures

ELECTROLYTIC CELL

DESCRIPTION OF THE INVENTION

Alkali metal chlorates are prepared by the electrolysis of aqueous alkali metal chloride solutions in an electrolytic cell where the anode and cathode face each other within the same electrolyte, that is, the anode and cathode are not separated from each other by a diaphragm or membrane. One form of the electrolytic cell utilized for the synthesis of alkali metal chlorates is a cell having a base-to-base bipolar electrodes where each single back-to-back bipolar electrode is arrayed in side-by-side configuration between a pair of bipolar electrodes parallel thereto and spaced therefrom. A structure of this type having individually manufactured, perforated anodes and individually manufactured, perforated cathodes on an individually fabricated bipolar element is shown in U.S. Pat. No. 3,902,985 to Carl W. Raetzsch et al. for ALKALI METAL CHLORATE CELL HAVING METAL BIPOLAR ELECTRODES.

It has been postulated that significant economies would result if a single metal blade could function as an anode for a portion of its length and a cathode for the remaining portion of its length as a single plate of graphite functioned as an anode for a portion of its length and a cathode for the balance of its length in prior art graphite bladed cells. One material suitable for providing both the anode and the cathode is titanium. Especially preferred is an alloy of titanium and yttrium as described, for example, in U.S. Pat. No. 4,075,070 of Donald W. DuBois et al. for ELECTRODE MATERIAL. The use of titanium-yttrium alloy allows a single piece of titanium to function as an anode along one portion of its length and as a cathode along the balance of its length. Especially preferred is imperforate titanium, e.g., a titanium sheet or titanium plate, because of the low cost of fabrication thereof.

However, the electrolytic evolution of hydrogen on the titanium results in some formation of titanium hydride, referred to herein as hydriding. The hydriding causes the titanium blade of the outboard cathode to bow away from the anode of the adjacent bipolar electrode toward the cell wall. It has now been found that if the cathodes on the outboard bipolar elements, i.e., the cathodes, only one surface of which faces an anode and the opposite surface of which faces the cell wall, are perforated, the deformation with hydride formation is significantly reduced.

THE FIGURES

DETAILED DESCRIPTION OF THE INVENTION

Figure 1:
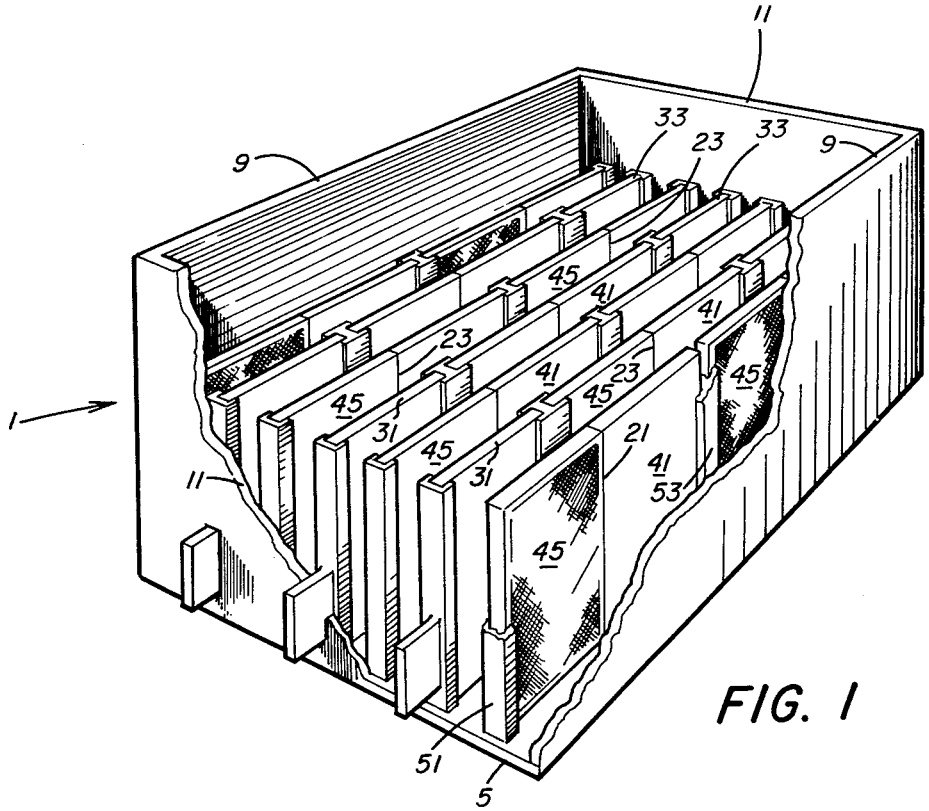
FIG. 1 is an isometric partial cutaway view of an electrolytic cell having the electrode structure described herein.
Figure 2:
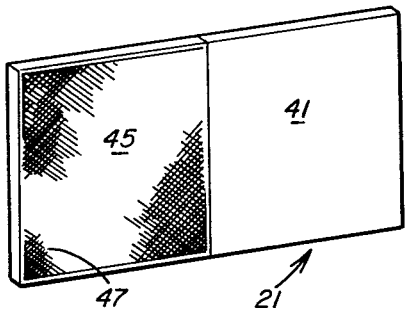
FIG. 2 is an isometric view of an outboard bipolar electrode having a perforated cathode portion, an imperforate anode portion, and intended to have one surface thereof facing complimentary electrodes and the opposite surface thereof facing the cell wall.
Figure 3:
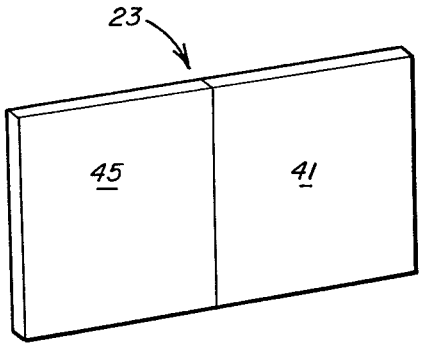
FIG. 3 is an isometric view of a bipolar electrode intended for use as an internal electrode where each of the opposite surfaces thereof face adjacent electrodes.

The electrolytic cell, 1, of this invention, has a cell body containing a cell bottom 5, cell side walls 9, cell back walls 11, and a cell top, not shown.

Within the cell box are individual bipolar electrodes 21, and 23, as well as individual half electrodes, i.e., half anodes 31, and half cathodes 33. The individual bipolar electrodes 21, and 23, have an anodic portion 41, and a cathodic portion 45.

An individual bipolar electrode is supported by U-shaped members 51, at the cell back walls 11, and H-shaped members 53, between bipolar electrodes, 21, 23.

The electrolytic cell 1, has a plurality of end-to-end bipolar electrodes 21 and 23 arrayed in side-by-side configuration in the cell box whereby the anodes 41 of internal bipolar electrode 23 face the cathodes 45 of adjacent bipolar electrode 23 and cathodes 45 of internal bipolar electrodes 23 face the anodes 41 of adjacent bipolar electrodes, 23. The anodes 41 of an external bipolar electrodes 21 face one cathode 45 of an internal bipolar electrode 23 and the exterior wall 9. Similarly, one surface of the cathode 45 of an external bipolar electrode 21 faces one anode 41 of an adjacent internal bipolar electrode 23 and the opposite surface of the cathode 45 faces a wall 9 of the cell box 1.

In the above configuration, only one surface of the cathode 45 of an external electrode 21 faces an anode. This one surface experiences a significantly higher amount of electrolytic activity taking effect thereon, resulting in a significantly higher amount of hydrogen being evolved thereon than the surface of the external cathode 45 facing the external wall 9 of the cell box. Accordingly, there is a higher likelihood of titanium hydride being formed on the interior facing surface of the cathode 45.

The tendency of the titanium cathode to become hydrided is reduced to some extent by utilizing as the cathode an alloy of titanium and yttrium containing from about 0.001 to about 1 weight percent yttrium, trace amounts of normal industrial impurities, balance titanium. However, even with the lower level of hydride formed, over extended periods of electrolysis, hydride will preferentially be formed on the interior facing or anode facing surface of the cathode 45, resulting in bowing away from the adjacent anode 41 of the internal bipolar electrode 23 spaced therefrom and parallel thereto. This is because the molar volume of titanium hydride is greater than the molar volume of the titanium.

It is herein contemplated to utilize as the cathode 45 of the external bipolar electrode 21 a perforated cathode. While not wishing to be bound by this explanation, it is believed that the perforations allow some cathodic hydrogen evolution to occur on the remote surface of the cathode 45, that is, a surface of the cathode 45 not facing an anode 41. The amount is such as to form a small amount of hydride, thereby resulting in a more even hydride formation on both surfaces, and a reduced tendency to bow.

The perforated surface 47 of the cathode 45 may be provided by mesh, expanded metal mesh, perforated sheet, perforated plate, or the like. Generally, the open area of the perforated cathode 45 should be from 10 to about 80 percent of the total cathode area, and preferably from about 30 to about 70 percent.

Preferably the open area is provided by substantially uniform pattern of perforations, for example, mesh having an open area provided by diamond shaped perforations where the long way of the diamond is from about 1 to about 1.8 times the short way of the diamond, the long way of the diamond being from about $\frac{1}{8}$ inch to about $\frac{3}{4}$ inch, and the short way of the diamond being in proportion thereto, and the thickness of the metal portion being from about 0.1 times the short way of the diamond to about 0.5 times the short way of the diamond. According to an alternative exemplification of this invention there is a provided a method of operating an electrolytic cell having a plurality of base-to-base bipolar electrodes, 21, 23 arrayed in side-by-side configuration in a cell box such that the anodes 43 of internal bipolar electrodes 23 face the cathodes 45, of bipolar electrode 23, 21, and the cathodes 45 of internal bipolar electrodes 23 face the anodes 41 of a pair of adjacent bipolar electrodes 21, 23 and whereby one surface of the anode 41 of an external bipolar electrode 21 faces a cathode 45 of an adjacent internal bipolar electrode 23 and the opposite surface of the anode 41 faces a wall 9 of the cell box, and one surface of the cathode 45A of an external bipolar electrode 21 faces one anode 41 of an internal bipolar electrode 23 and the opposite surface of the cathode 45 faces a wall 9 of the cell box 1, where the cathodes 45, 45A are fabricated of titanium and the internal electrodes 23 are imperforate. The method of the invention comprises providing an aqueous electrolyte, for example, an aqueous alkali metal chloride, alkali metal metal chlorate solution in the cell, and imposing an electrical potential across the cell so as to evolve hydrogen at the cathode. A portion of the evolved hydrogen forms titanium hydride at the cathode. According to the method disclosed herein, the cathodes 45 of the external bipolar electrodes 21 have a perforated surface 47 thereon whereby to evolve hydrogen and form hydride on the external surface thereof, that is, the surface remote from the anodes 45 of adjacent internal electrodes 23, and facing the cell wall 9.

In the operation of sodium chlorate cells of the prior art, the combination of thick carbon electrodes and low current densities necessitated by the carbon electrodes, e.g., less than about 100 amperes per square foot, provided a cell operating temperature of about 35° to about 50° C. In such cells solid sodium chloride had to be substantially continuously added to the cell.

According to this invention, electrolytic cells are provided having compact electrolysis volumes, but permitting the use of metal electrodes of simple construction, and large cell bodies, i.e., cell bodies characterized by large electrolyte volumes. In this way, a small volume is utilized for electrolysis while a large volume is provided for the chemical formation of chlorate ion. Because of the increased electrolyte temperature of the electrolyte, e.g., from about 50° C. to the boiling point of the electrolyte due to the higher current densities obtained with metal electrodes, and to the enhanced chemical stability thereof with respect to graphite, the solubility of alkali metal chlorates in cell liquor is increased. The large cell volume relative to electrode volume provides a longer cell residence time. The combination of higher temperatures, higher chlorate solubility, and longer residence time provides higher concentrations of chlorate in the cell liquor. The longer times allows more of the chlorate to be formed by chemical reaction rather than by electrolysis, thereby providing a higher current efficiency. The higher temperature allows a brine feed to be utilized rather than solid salt feed.

While the invention has been described with respect to certain preferred exemplifications and embodiments thereof, it is not intended to limit the invention thereby but only by the claims appended hereto.

I claim:

1. In an electrolytic cell having a plurality of base-to-base, vertical bipolar electrodes, each of said bipolar electrodes comprising a single metal blade having an anodic portion and a cathodic portion, and being bipolar electrodes arrayed in side-by-side configuration in a cell box whereby the anode of an internal bipolar electrode faces the cathodes of adjacent bipolar electrodes within the same electrolyte and the cathode of an internal bipolar electrode faces the anodes of adjacent bipolar electrodes within the same electrolyte, and whereby one surface of the anode of an external bipolar electrode faces one cathode of an adjacent bipolar electrode and the opposite surface thereof faces a wall of the cell box, and one surface of the cathode of an external bipolar electrode faces one anode of an adjacent bipolar electrode and the opposite surface thereof faces a vertical wall of the cell box, the improvement wherein the cathodes are fabricated of titanium, the internal cathodes being imperforate and the external cathodes being perforate.

2. The electrolytic cell of claim 1 wherein the titanium is alloyed with yttrium.

3. In a method of operating an electrolytic cell having a plurality of base-to-base, vertical bipolar electrodes each of said bipolar electrodes comprising a single metal blade having an anodic portion and a cathodic portion, and being arrayed in side-by-side configuration in a cell box whereby the anode of an internal bipolar electrode faces the cathodes of adjacent bipolar electrodes within the same electrolyte and the cathode of an internal bipolar electrode faces the anodes of adjacent bipolar electrodes within the same electrolyte, and whereby one surface of the anode of an external bipolar electrodes faces one cathode of an adjacent bipolar electrode and the opposite surface thereof faces a wall of the cell box, and one surface of the cathode of an external bipolar electrode faces one anode of an adjacent bipolar electrode and the opposite surface thereof faces a vertical wall of the cell box, the cathodes being fabricated of titanium and the internal electrodes being imperforate, which method comprises providing an aqueous electrolyte in the cell, imposing an electrical potential across the cell and evolving hydrogen at the cathodes, a portion of the hydrogen forming titanium hydride at the cathode, the improvement wherein the external cathodes are perforate whereby to evolve hydrogen and form titanium hydride on the external surfaces thereof.

4. The method of claim 3 wherein the titanium is alloyed with yttrium.

* * * * *